United States Patent [19]

Dreulle et al.

[11] 4,437,965

[45] Mar. 20, 1984

[54] REINFORCED LEAD ANODE FOR THE ELECTROLYTIC PRODUCTION OF ZINC FROM SULPHATE SOLUTION AND PROCESS FOR THE PREPARATION THEREOF

[75] Inventors: Noël Dreulle; Alain Van Ceulen; Claude Eusebe, all of Douai, France

[73] Assignee: Compagnie Royale Asturienne des Mines, Brussels, Belgium

[21] Appl. No.: 357,195

[22] Filed: Mar. 11, 1982

[30] Foreign Application Priority Data

Mar. 18, 1981 [FR] France ..... 81 05396

[51] Int. Cl.[3] ..... C25B 11/00

[52] U.S. Cl. ..... 204/290 F; 204/114; 204/119; 156/60

[58] Field of Search ..... 204/290 R, 290 F, 114, 204/119, 292; 156/60

[56] References Cited

U.S. PATENT DOCUMENTS

| | | | |
|---|---|---|---|
| 1,302,959 | 5/1919 | Page | 204/290 R |
| 3,844,921 | 10/1974 | Benedict | 204/290 F |
| 4,088,558 | 5/1978 | Fabian | 204/290 F |
| 4,260,470 | 4/1981 | Fisher | 204/290 F |
| 4,380,493 | 4/1983 | Wortley | 204/292 |

FOREIGN PATENT DOCUMENTS

| | | |
|---|---|---|
| 2399490 | 3/1979 | France . |
| 869618 | 5/1961 | United Kingdom . |
| 1394694 | 5/1975 | United Kingdom . |

*Primary Examiner*—John F. Niebling

*Attorney, Agent, or Firm*—Young & Thompson

[57] ABSTRACT

The anodes for the electrolytic production of zinc from acid aqueous solutions of sulphate comprise a skin portion formed by conventional anode metal, lead containing from 0.25 to 1.0% silver, and a stiffening reinforcing member of titanium or zirconium. The reduction in thickness of the anodes, which is made possible by the provision of the reinforcing member, results in a substantial saving in the amount of silver-bearing lead which is immobilized, and a substantial reduction in the unit weight of the anodes. The resistance of the lead to anodic corrosion in a sulphuric acid medium is maintained and the resistance to corrosion by passivation of the reinforcing member permits the reinforcing member to be accidentally exposed, without disadvantage. To produce the anodes, the reinforcing members are clad with lead at a temperature of more than 100° by rolling sheets of lead, by casting in a mould or by spraying on molten lead.

7 Claims, No Drawings

REINFORCED LEAD ANODE FOR THE ELECTROLYTIC PRODUCTION OF ZINC FROM SULPHATE SOLUTION AND PROCESS FOR THE PREPARATION THEREOF

FIELD OF THE INVENTION

The present invention relates to a reinforced lead anode for the electrolytic production of zinc from aqueous acid solutions of sulphate which includes a reinforcing member. The invention also relates to a process for the production of such an anode.

BACKGROUND OF THE INVENTION

At the present time, the major part of the zinc which is produced from ore is produced by hydrometallurgy, with the production of metal zinc by electrolysis of aqueous acid solutions of sulphate in vessels which are provided with insoluble anodes. The electrolysis baths contain free sulphuric acid and at the same time as zinc is deposited at the cathode, oxygen is given off and free sulphuric acid is formed at the anode.

The nature of the metal forming the insoluble anodes is selected on the basis of the following considerations: the anodes must be capable of resisting corrosion in a sulphuric acid medium and in the presence of nascent oxygen, and the polarisation voltage acquired by the anode must be low. In actual fact, in the production of a metal by electrolysis, the energy cost is a substantial part of the cost price, and the level of efficiency in regard to the consumption of energy in electrolytic reduction, which is partly determined by anode polarisation, cannot be neglected. The problems involved with insoluble anodes are frequently considered in regard to the electrolytic deposits of coatings using high-cost metals, where the energy costs are a less important part of the overall cost, while the qualities of the metal deposited are more important. In addition, the electrolytic production of metals is a heavy industry, so that the problems in regard to tonnages and handling are of real importance.

The limitations in regard to corrosion resistance and a low level of anodic polarisation have resulted in lead being virtually universally used as the anode metal. The lead contains from 0.25 to 1.0% by weight of silver which improves the mechanical qualities of the anodes (increase in rigidity and hardness), and also resistance to corrosion in the presence of impurities in the baths, in particular chlorides.

Lead anodes are generally plates of rectangular shape, with geometrical surface areas ranging from 0.55 to 1.7 square meters, the thicknesses of the plates ranging correlatively from about 8 to 16 mm, and the weights of the plates being from 50 to 300 kg. It should be noted that the anodic surface areas of the plates are double the geometrical surface areas, with both faces of the plate being active as an anode. To give an idea of the order of magnitude, an electrolysis shop producing 100,000 tonnes of zinc per annum uses 2376 tonnes of lead, containing close to 12 tonnes of silver, for the anodes, that is to say, close to 10,900 plates of a unit weight of 218 kg. In an installation of this type, the capital investment cost in respect of anodes may be up to 20% of the total investment. It is clear that a reduction in the weight of the anodes would have substantial repercussions on the capital investment and also on the costs involved in the handling operations (each anode is removed from the bath 6 to 8 times per year, which represents overall from 220 to 300 handling operations daily). However, the mechanical properties of the lead used do not permit the thickness of the plates to be reduced, without running the risk of deformation when the plates are being handled and in operation thereof, and premature deterioration.

It is possible to envisage using composite anodes with a stiffening reinforcing member of mechanically strong metal, with the reinforcing member being enclosed in a lead sheath. It is generally the usual practice in electrochemical operations to use electrodes with an active surface which is adapted to the electrochemical use in point and which is plated to a core portion or reinforcement, the nature of which is so selected as to be appropriate to a particular situation (cost, compatibility with the active surface portion, facility of machining, mechanical strength, electrical conductivity, and the like).

PRIOR ART

Thus, French patent No. 2399490 proposes lead anodes which are formed by bundles of aluminium rods sheathed with silver-bearing lead. Such anodes are used to permit improved circulation of the electrolyte, besides the savings made on the silver-bearing lead, but those anodes are not suitable for replacing the conventional anodes in the existing installations. In addition, it is clear from the description of the above-indicated patent that the sheathed aluminium anodes are more delicate than conventional anodes.

OBJECT OF THE INVENTION

It is an object of the present invention to provide a lead anode for the production of zinc, which is reduced in weight by virtue of an internal reinforcing member, the nature of the reinforcing member being such that the savings resulting from the reduction in weight are not counterbalanced by an increase in the cost of production of the anodes, by difficulties occurring in operation of the anode, or by the anode becoming obsolete more quickly. It is also an object of the present invention to provide a reinforced lead anode in which the reinforcing member cannot cause pollution of the bath or electrolyte.

SUMMARY OF THE INVENTION

For this purpose, the present invention proposes in a lead anode for the electrolytic production of zinc from aqueous solutions of sulphate, including a reinforcing member, the improvement comprising making the reinforcing member from a material selected from the group comprising titanium and zirconium and confining the reinforcing member between two layers of lead.

The above-indicated metals, titanium and zirconium, have mechanical properties in regard to lightness and rigidity which are virtually equalled only by light alloys (aluminium, magnesium), which however cannot be used in the situation under consideration. They are commercially available at a cost which is not excessive. And in particular, they have an excellent level of corrosion resistance, by virtue of passivation. If the anode reinforcing member is exposed as a result of impacts or arcs following a shortcircuit, the anodic passivation effect protects the exposed metal and locally suppresses the flow of current by establishing a contact potential which is higher than that of the lead covering.

The advantages of low density, cost and commercial availability are particularly marked in regard to titanium, which is preferred.

The reinforcing members used preferably are apertured, by perforation, weaving, or of expanded metal, in order to achieve the desired rigidity in the reinforcing member, while using less metal. In addition, the apertures and surface roughnesses of the reinforcing member improve the adhesion of the layer of lead.

In accordance with another aspect, the invention proposes a process for the production of a lead anode for the electrolytic production of zinc from aqueous solutions of sulphate, in which a reinforcing member of a metal selected from the group comprising titanium and zirconium is confined between two layers of lead, the layers of lead being applied to the reinforcing member at a temperature higher than 100° C. At temperatures of more than 100° C., lead is more malleable (increased plasticity and flow capability, and better recrystallisation properties).

In particular, the operation of rolling a composite formed by the reinforcing member between two sheets of lead preferably is performed at a temperature in the range of from 100° to 250° C.

It is also possible for the reinforcing member to be covered with lead in the course of solidification, either by immersing the reinforcing member in molten lead or by casting lead over the reinforcing member in a suitable mould, or by spraying molten lead onto the reinforcing member.

Other objects and features of the invention will become apparent from the following detailed description of preferred but non-limitative embodiments.

EXAMPLE 1

Experimental production

To determine the conditions in respect of production and use of anodes for industrial installations, experimental anodes were produced in a first phase, in the following manner:

A titanium plate of 1.0 mm thickness, 250 mm in length and 150 mm in width, and which was apertured with holes 6 mm in diameter, with an inter-axis spacing of 10 mm (proportion of open space about 30%) was sandwiched between two lead plates containing 0.5% of silver, of the same length and width as the titanium plate, and being 2.86 mm in thickness. This assembly was raised to 200° C. and rolled in the direction of the length thereof, with the gap between the rolling mill rolls being 5 mm. After the rolling operation, the anode was routed at the level of the titanium reinforcing member to the following sandwich dimensions: length 264 mm, width 150.5 mm, total thickness 5.05 mm, thickness of the titanium reinforcing member 0.95 mm. A thermal weld line was then formed on the edge of the sandwich, using lead containing 0.5% of silver as the additive weld material.

Five anodes were produced in the above-described manner, for use in a laboratory electrolysis cell, two anodes having defects in the covering, of 1 and 4 $cm^2$ in area respectively, produced deliberately by locally removing lead.

EXAMPLE 2

Preferred Production Process

To replace lead anodes with a geometrical surface area of 1.36 $m^2$, which were 14 mm in thickness, 218 kg in weight, giving 160.3 $kg/m^2$, and containing 0.5% of silver (1.09 kg, namely 0.80 $kg/m^2$), anodes were produced as follows:

Taking a titanium plate measuring 1.0 mm in thickness, 1.50 m in length and 0.86 m in width, and apertured with holes which were 6 mm in diameter, with an inter-axis spacing of 10 mm, in lines at 45° to the length of the plate, two sheets of lead containing 0.5% of silver, being 2.86 mm in thickness and of the same dimensions as the titanium plate were disposed on respective sides of the titanium plate. The assembly was raised to a temperature of 200° C. and rolled at that temperature between rolling mill rolls with a roll gap of 5.0 mm. The anode was then routed to its final dimensions (1.58×0.86 m) and then provided on its edges with a weld line using lead containing 0.5% of silver as the additive material.

When manufactured in this manner, the anode weighed 66.9 kg, comprising 4.1 kg of titanium and 62.8 kg of lead containing 0.5% silver, giving 0.314 kg of silver. That corresponds to 49.2 kg/square meter comprising 3 kg of titanium and 46.2 kg of lead containing 0.5% of silver (0.23 kg of silver).

The saving in silver-bearing lead was therefore 114 kg (0.57 kg of silver) per square meter.

EXAMPLE 3

Use

The operating tests were carried out using an experimental cell provided with the five anodes of Example 1, and four cathodes, each between two successive anodes, having an active surface area of 8.52 $dm^2$ (geometrical surface area of 4.26 $dm^2$). The electrical power source produced a stabilised current at an adjustable value, with the voltage between anodes and cathodes being measured. The electrolyte as initially formed in the cell contained 170 g/l of free sulphuric acid and zinc sulphate in a concentration of 40 g/l reckoned in the form of metal zinc, and was maintained at those levels of concentration by the addition of a neutral solution of zinc sulphate, that addition being made in dependence on the conductivity of the bath. The cell was also provided with an overflow arrangement. The excess of electrolyte which flowed out through the overflow arrangement, which is usually referred to as cell acid or return acid, constituted a purge for reducing the concentration of free acid, and was collected. Electrolyte samples were taken off (mean samples) and quantitatively analysed to monitor operation of the experimental installation.

The only variable used for the tests was the current density. In practice the levels of concentration of free sulphuric acid and zinc sulphate differ little from one installation to another throughout the world, and in the ranges involved, the variations in concentration have virtually no effect on the anodic electrochemical process.

In addition, the tests were carried out using periods of activity of about 48 hours at constant current, after which the cathodes were removed and weighed and the deposited zinc removed, while the anodes were left in the bath, without a current flow. The results are set out in the following table.

TABLE

| | Test 3A | Test 3B | Test 3C |
|---|---|---|---|
| cell current | 68.38 | 102.58 | 136.75 |

TABLE-continued

| | Test 3A | Test 3B | Test 3C |
|---|---|---|---|
| Amperes cathodic current density Amperes/m$^2$ | 200 | 300 | 400 |
| anode/cathode voltage volts | 3.12 | 3.24 | 3.45 |
| weight of zinc (in 48 hours) grams | 3623 | 5368 | 7181 |
| current efficiency % | 90.5 | 89.4 | 89.7 |

The values in the Table are virtually identical to the values which are achieved with conventional anodes of solid lead with the same silver content.

After 56 days of testing, comprising a total of 40 days active operation, and a total of 16 stoppage days, the anodes were removed from the cell, washed, brushed and examined. The silver-bearing lead surfaces did not show any abnormal change. The exposed titanium (defects produced deliberately) was intact and there was no sign of incipient detachment of the lead around the defects.

All these tests showed that, from the points of view of electro-chemical operation and corrosion resistance, the anodes of the invention with their titanium reinforcement are equivalent to solid lead anodes.

The use of anodes as set forth in Example 2 makes it possible to use only about 30% of the amount of lead and silver which is used in conventional installations. The weight of an anode of the invention is reduced to 31% of the weight of the conventional anode. Taking into account the present cost of the titanium reinforcing members, the levels of capital investment in anodes can be reduced by 45%.

A certain number of tests were carried out to evaluate the most effective production processes in relation to the reinforcing member structures. The reinforcing member structures tested were perforated sheet metal, metal grid and woven metal structures, and expanded metal. Using the perforated sheet metal, rolling at a temperature of about 200° was found to be appropriate, and preparation of the sheet metal by dulling the surface thereof is found to be an advantageous step.

Cladding the reinforcing member with lead by casting lead in a mould in which the reinforcing member is held in a centralised position is particularly recommended when the reinforcing member is of a slack or loose structure (expanded metal or a metal grid structure with large mesh).

The tight woven and grid structures can be covered with lead by spraying molten lead by means of a known process. Cladding the above-mentioned reinforcing structures after they have been suitably prepared, by immersing them in molten lead, gives good results if the temperature of the molten lead and the speed of emersion are accurately controlled.

Tests with zirconium instead of titanium have confirmed that the mechanical and electro-chemical behaviour of zirconium was at least as good as when using titanium. The higher specific gravity of zirconium (6.5) had virtually no effect on the weight of the anodes (an increase of 1.3 kg/m$^2$, that is to say, 2%), but had a slight effect on the tonnage used (an increase of 45%).

What we claim is:

1. In a lead anode for producing zinc from aqueous solutions of zinc sulphate, the improvement wherein said lead anode comprises a thin, generally flat reinforcing member and an active part comprising argentiferous lead coated on said reinforcing member, said reinforcing member being made of a metal selected from the group consisting of titanium and zirconium, and said argentiferous lead coating comprising a layer on each side of said reinforcing member, the two layers being joined along their peripheral edges and the total thickness of the two layers being greater than the thickness of said reinforcing member.

2. An anode according to claim 1, wherein said reinforcing member is apertured.

3. A process of making a lead anode for producing zinc from aqueous solutions of zinc sulphate, the steps comprising providing a thin, generally flat reinforcing member of metal selected from the group consisting of titanium and zirconium, forming two spaced apart sheets of argentiferous lead, and applying said argentiferous lead sheets by rolling at a temperature in the range of from 100° to 250° C.

4. A process according to claim 3, further comprising welding the peripheral edges of said sheets of lead together.

5. In an electrolytic cell for producing zinc, containing an aqueous solution of zinc sulphate including free sulphuric acid, and a lead anode, the improvement wherein said lead anode comprises a thin, generally flat member made of metal selected from the group consisting of titanium and zirconium, and a layer of argentiferous lead on each side of said reinforcing member, the total thickness of the two layers being greater than the thickness of said reinforcing member, and said layers being joined together along their peripheral edges.

6. An anode according to claim 1, wherein the thickness of each of said argentiferous lead layers is about twice that of said reinforcing member.

7. An anode according to claim 6, wherein the thickness of each of said argentiferous lead layers is about 2 mm.

* * * * *